US008448721B2

(12) United States Patent
Johnson

(10) Patent No.: US 8,448,721 B2
(45) Date of Patent: May 28, 2013

(54) DIRECTIONAL DRILLING SYSTEM

(75) Inventor: Ashley Johnson, Milton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 332 days.

(21) Appl. No.: 12/808,485

(22) PCT Filed: Dec. 16, 2008

(86) PCT No.: PCT/IB2008/003949

§ 371 (c)(1),
(2), (4) Date: Sep. 27, 2010

(87) PCT Pub. No.: WO2009/101476

PCT Pub. Date: Aug. 20, 2009

(65) Prior Publication Data

US 2011/0031022 A1 Feb. 10, 2011

(30) Foreign Application Priority Data

Dec. 19, 2007 (GB) ..... 0724661.4

(51) Int. Cl.
*E21B 7/06* (2006.01)
*E21B 10/26* (2006.01)

(52) U.S. Cl.
USPC ..... 175/61; 175/73; 175/76; 175/385

(58) Field of Classification Search
USPC ..... 175/385–392, 61, 73, 76
See application file for complete search history.

(56) References Cited

U.S. PATENT DOCUMENTS

| | | | | |
|---|---|---|---|---|
| 6,607,046 | B1 | 8/2003 | Betts et al. | |
| 7,258,165 | B1 | 8/2007 | Williams | |
| 7,287,609 | B2 | 10/2007 | Runia et al. | |
| 7,562,725 | B1 * | 7/2009 | Broussard et al. | 175/93 |

FOREIGN PATENT DOCUMENTS

| | | |
|---|---|---|
| CN | 2252877 Y | 4/1997 |
| DE | 3927625 | 2/1991 |
| DE | 4211059 | 7/1993 |
| EP | 563950 | 10/1993 |
| JP | 1986176789 | 8/1986 |
| JP | 1991110288 | 5/1991 |
| WO | 01/36782 | 5/2001 |
| WO | 03/008754 | 1/2003 |
| WO | 2004/046505 | 6/2004 |

* cited by examiner

*Primary Examiner* — Giovanna Wright
(74) *Attorney, Agent, or Firm* — Chadwick A. Sullivan

(57) ABSTRACT

A directional drilling system comprises a main drill bit 24 rotatable about a main bit axis 26, a pilot drill bit 34 rotatable about a pilot bit axis 36 substantially parallel to the main bit axis 26, and adjustment means 28 for adjusting the position of the pilot bit axis 36 relative to the main bit axis 26.

12 Claims, 2 Drawing Sheets

DIRECTIONAL DRILLING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to a directional drilling system for use in the formation of boreholes, for example for subsequent use in the extraction of hydrocarbons.

A number of directional drilling systems are known. For example it is known to provide a drilling system with a bias unit operable to apply a laterally directed force to a drill bit thereof to urge the drill bit towards a position in which it is offset from the axis of the borehole so that continued operation of the drilling system results in a deviation being formed in the borehole. Another form of steerable drilling system incorporates a bent housing or sub, the orientation of which can be adjusted to control the direction in which the associated drill bit is pointed so as to control the direction in which continued operation of the drilling system extends the borehole.

WO03/008754 describes an arrangement in which a pilot bit is located ahead of a main bit, the pilot bit being mounted upon a spherical bearing to allow it to be pointed in a desired direction and thereby achieve steering of the drilling system.

It is an object of the invention to provide a directional drilling system of relatively simple and convenient form.

BRIEF SUMMARY OF THE INVENTION

According to the invention there is provided a directional drilling system comprising a main drill bit rotatable about a main bit axis, a pilot drill bit rotatable about a pilot bit axis substantially parallel to the main bit axis, and adjustment means for adjusting the position of the pilot bit axis relative to the main bit axis.

Preferably the main bit is provided with a plurality of wear pads engageable, in use, with the wall of a pilot bore formed by the pilot bit to guide the main bit.

In use, when it is desired to direct the borehole in a chosen direction, the pilot bit axis is held in a position in which it is offset from the main bit axis in the chosen direction so as to form a pilot bore in that location. Subsequent engagement of the wear pads with the pilot bore result in lateral forces being applied to the main bit urging it in the chosen direction. When it is desired to form a generally straight borehole region, the position of the pilot bit axis is continually or substantially continually changed so that no or little net laterally directed force is applied to the main bit.

The pilot bit axis is preferably offset from the main bit axis by a fixed distance.

The system conveniently incorporates a steering shaft which extends generally coaxially with the main bit, a drive shaft of the pilot bit being supported for rotation by the steering shaft, the drive shaft of the pilot bit being eccentric to the steering shaft.

The pilot bit is preferably arranged to be driven by the rotation of the main bit, for example through a sun and planet type gear arrangement, the planet gears of which are preferably carried by the steering shaft.

A motor may be provided to control the angular position of the steering shaft. Alternatively, a brake may be provided to control the position of the steering shaft.

The invention also relates to a method of drilling using a directional drilling system as defined hereinbefore, the method comprising the steps of using the pilot bit to form a pilot bore, using the main bit to form a main bore, and adjusting the position of the pilot bit axis relative to the main bit axis to control the position of the pilot bore relative to the main bore.

BRIEF DESCRIPTION OF THE SEVERAL VIEWS OF THE DRAWINGS

The invention will further be described, by way of example, with reference to the accompanying drawings, in which.

DETAILED DESCRIPTION OF THE INVENTION

Figure 1:
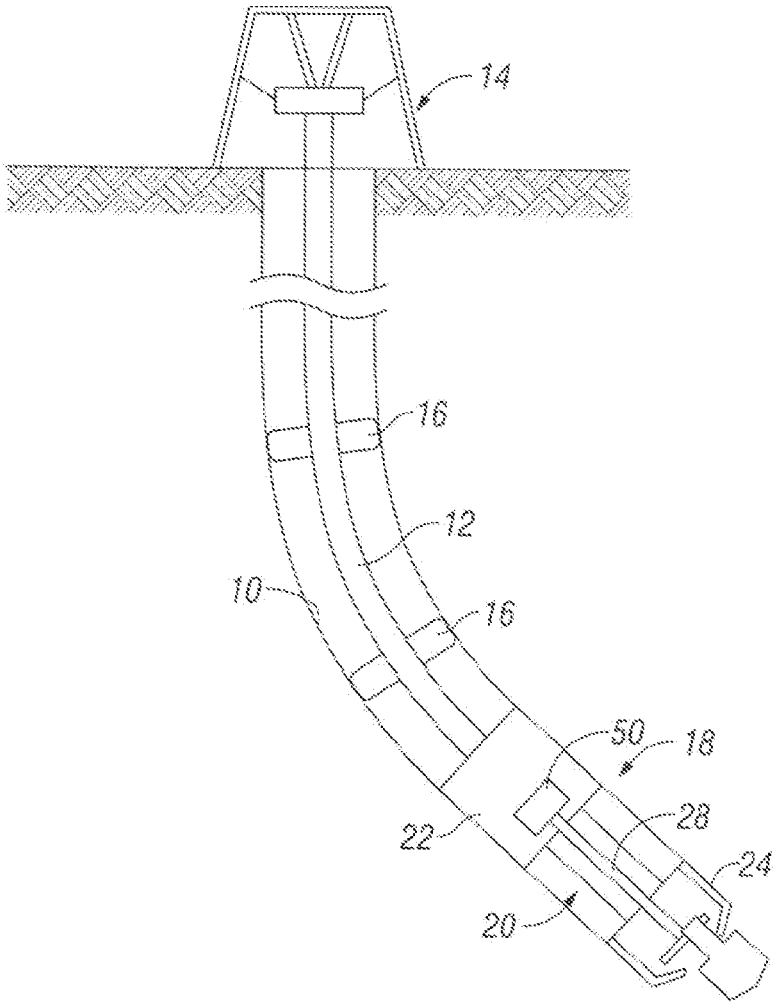
FIG. 1 is a diagrammatic view illustrating a directional drilling system in accordance with one embodiment of the invention.
Figure 2:
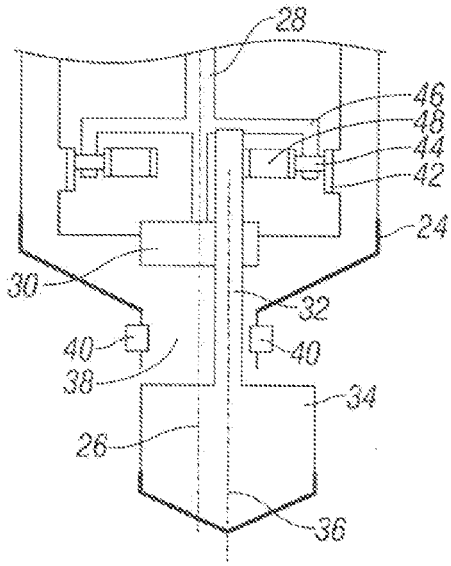
FIG. 2 is a diagrammatic view, to an enlarged scale, illustrating part of the drilling system of FIG. 1.
Figure 3:
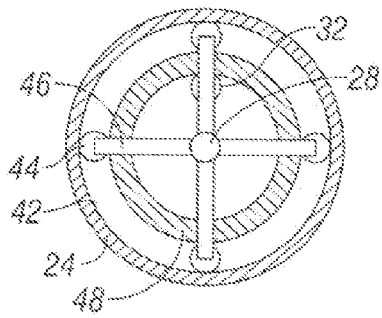
FIG. 3 is a diagrammatic sectional view illustrating part of the gearbox arrangement of the embodiment of FIG. 2.
Figure 4:
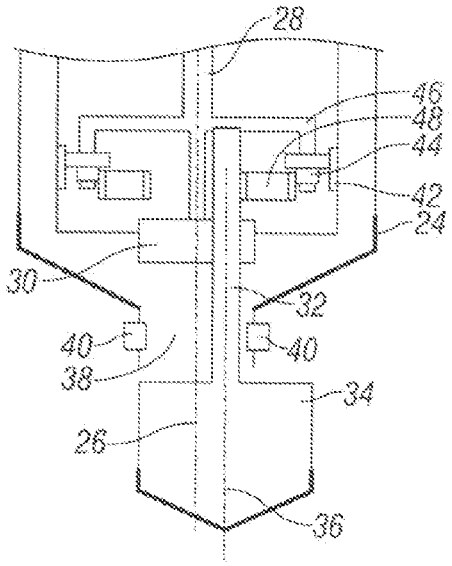
FIG. 4 is a view similar to FIG. 2 illustrating an alternative embodiment.

Referring firstly to FIGS. 1 to 3 there is illustrated a drilling system being used in the formation of a borehole 10. The system comprises a drill string 12 supported by a surface rig 14 and, at intervals along its length, by stabilisers 16. At its lower end, the drill string 12 carries a bottom hole assembly 18 including a downhole motor 20 and a control housing 22. The downhole motor 20 may take a range of forms. For example it may be electrically powered, or alternatively may be hydraulically driven using fluid supplied through the drill string 12 under pressure. An output of the downhole motor 20 is arranged to drive a main bit 24 for rotation about a main bit axis 26.

The control housing 22 contains a control arrangement (not shown) operable to control the angular or rotary position of a steering shaft 28 which extends coaxially with the main bit 24. At its free end, the steering shaft 28 is provided with an enlarged diameter region 30 carrying bearings (not shown) which support a drive shaft 32 for rotation. Thrust bearings are also provided to permit a weight on bit loading to be transmitted to the drive shaft 32. The drive shaft 32 supports or is formed integrally with a pilot bit 34. The bearings are arranged such that the pilot bit axis 36 (the axis of rotation of the pilot bit 34 and drive shaft 32) is eccentric to or offset from the main bit axis 26. The offsetting of the axes 26, 36 is exaggerated in the drawings. It will be appreciated that the angular position of the steering shaft 28 governs the direction in which the pilot bit axis 36 is offset from the main bit axis 26, thus the steering shaft 28 constitutes an adjustment means for adjusting the position of the pilot bit axis 36

As illustrated, the pilot bit 34 projects from an opening 38 formed in the main bit 24. Around the opening 38 is provided a series of wear pads 40. In the arrangement illustrated, the opening 38 is of diameter smaller than the pilot bit 34, and the wear pads 40 are similarly located around a circle of smaller diameter than the pilot bit 34. However, this need not be the case and the wear pads 40 may be arranged around a circle of diameter substantially equal to that of the pilot bit 34 if desired.

The pilot bit 34 is preferably arranged to be driven from the main bit 24. In the arrangement illustrated this is achieved by providing a planet/sun gearbox arrangement in which the main bit 24 is provided, internally, with a toothed ring gear formation 42. The ring gear formation 42 may be formed integrally with the main bit 24 or alternatively may comprise a separate component rigidly secured thereto. The teeth of the ring gear formation 42 mate with the teeth of a series of planet gears 44 which are rotatably mounted upon spider 46 supported by or forming part of the steering shaft 28. The planet gears 44 further mate with an inner ring gear 48 which, in turn, mates with and drives the drive shaft 32 and pilot bit 34 for rotation.

In use, the motor 20 drives the main bit 24 for rotation about the main bit axis 26. The rotation of the main bit 24 is transmitted through the planet/sun gearbox arrangement to the pilot bit 34, causing rotation thereof about the pilot bit axis 36. The position of the pilot bit axis 36 relative to the control housing 22 is controlled by the steering shaft 28. When it is desired to form a deviation in the borehole being formed in a chosen direction, the steering shaft 28 is held against rotation, ie it is held geostationary, in an angular position in which the pilot bit axis 36 is offset from the main bit axis 26 in the desired direction. With the steering shaft 28 held in this position, continued operation of the motor 20, in combination with an applied weight on bit loading, results in both the main bit 24 and the pilot bit 34 being rotated about their respective axes, both bits serving to gauge, abrade, scrape or otherwise remove formation material. This action results in the pilot bit 34 forming a pilot bore which is offset from the main bit axis 26, and in the main bit 24 extending the borehole 10. When the main bit 24 reaches a position in which the wear pads 40 move into engagement with the walls of the pilot bore it will be appreciated that they will apply a lateral force to the main bit 24 urging the main bit 24 in the chosen direction, thereby steering the drilling system in the chosen direction.

When it is desired to form a region of the borehole 10 that is generally straight, the steering shaft 28 is allowed to rotate freely. Consequently, the position of the pilot axis 36 changes continually and no net lateral force is applied to the main bit 24, over time, by the engagement of the wear pads 40 with the borehole wall. In practise, the steering shaft 28 will typically rotate relatively slowly in these circumstances, the speed of rotation thereof being determined by the difference in torque between the main and pilot bits 24, 34.

It will be appreciated that, as steering of the main bit 24 is achieved by the engagement of the wear pads 40 with the walls of the pilot bore rather than engagement with those of the main borehole 10, the risk of damaging the main borehole 10 is reduced. Also, the wear pads 40 can be made of increased length, hence having a larger contact area with the borehole wall and reducing the applied contact pressure.

In use, the torque required to hold the steering shaft 28 against rotation may be fairly high. For example, it may be comparable with the torque applied to the main bit 24. In order to generate the torque necessary to hold the steering shaft 28 against rotation it is thought that a suitable motor 50, for example of electrically power or hydraulically powered form, may be provided in the control housing 22.

Alternatively, as illustrated in FIG. 3, by modification of the planet/sun gearbox arrangement it is possible to ensure that the torque required to drive the steering shaft 28 is in the same direction as the bottom hole assembly 18 rotates in use, thus permitting a simple brake, in combination with the rotation of the bottom hole assembly 18, to be used to control the rotation of the shaft 28, thereby avoiding the necessity of providing a separate motor 50 for the shaft 28.

It will be appreciated that the arrangements described hereinbefore are advantageous in that they can be used to form straight or deviated borehole regions, are relatively short, for example approximately the length of two conventional drill bits, can be controlled simply by controlling the position of a single shaft, and do not require control to be synchronous with the rotation or bottom hole assembly position.

A number of other components will typically be provided, as is usual with downhole drilling systems, and drilling fluid or mud passages will typically be provided, as usual, to allow the supply of fluid to the drill bits. However, the provision of these components or features is ancillary to the invention and so is not described in detail herein.

A number of modifications and alterations may be made to the arrangements described hereinbefore without departing from the scope of the invention.

The invention claimed is:

1. A directional drilling system comprising a main drill bit rotatable about a main bit axis, a pilot drill bit rotatable about a pilot bit axis substantially parallel to the main bit axis, the pilot bit axis remaining substantially parallel to the main bit axis and offset from the main bit axis during an operation, and an adjustment mechanism comprising a steering shaft which extends coaxially with the main drill bit for adjusting a position of the pilot bit axis relative to the main bit axis, wherein the pilot drill bit is rotated about the pilot bit axis simultaneously with rotation of the main drill bit about the main bit axis to effect a steering change while both the pilot drill bit and the main drill bit are rotating at radially offset positions.

2. A system according to claim 1, wherein the main drill bit is provided with a plurality of wear pads engageable, in use, with a wall of a pilot bore formed by the pilot bit to guide the main bit.

3. A system according to claim 1, wherein the pilot bit axis is offset from the main bit axis by a fixed distance.

4. A system according to claim 1 wherein a drive shaft of the pilot drill bit is supported for rotation by the steering shaft, the drive shaft of the pilot drill bit being eccentric to the steering shaft.

5. A system according to claim 1, wherein the pilot drill bit is arranged to be driven by the rotation of the main drill bit.

6. A system according to claim 5, wherein the pilot drill bit is driven from the main drill bit through a sun and planet type gear arrangement.

7. A system according to claim 4, wherein a motor is provided to control an angular position of the steering shaft.

8. A system according to claim 4, wherein a brake is provided to control a position of the steering shaft.

9. A method of drilling using a directional drilling system, the method comprising using a pilot drill bit to form a pilot bore, using a main drill bit to form a main bore, maintaining a pilot bit axis substantially parallel to a main bit axis and offset from the main bit axis during an operation in which the main drill bit rotates about the main bit axis and the pilot drill bit simultaneously rotates about the pilot bit axis, and adjusting the position of the pilot bit axis relative to the main bit axis with a steering shaft to control the position of the pilot bore relative to the main bore and to thus effect a desired directional change while both the pilot drill bit and the main drill bit are rotating at radially offset positions.

10. A method according to claim 9, wherein the main drill bit is provided with a plurality of wear pads and wherein engagement of the wear pads with the pilot bore results in the application of a generally laterally directed force to the main drill bit.

11. A method according to claim 9, wherein an orientation of the steering shaft is controlled using a motor.

12. A method according to claim 9, wherein an orientation of the steering shaft is controlled using a brake.

* * * * *